United States Patent [19]

Gallusser et al.

[11] Patent Number: 4,641,899

[45] Date of Patent: Feb. 10, 1987

[54] MULTI-PART ELECTRICAL CONNECTOR ASSEMBLY

[75] Inventors: David O. Gallusser, Oneonta; Stephen Punako, Bainbridge, both of N.Y.

[73] Assignee: Allied Corp., Morristown, N.J.

[21] Appl. No.: 757,826

[22] Filed: Jul. 18, 1985

[51] Int. Cl.[4] ..... H01R 11/00

[52] U.S. Cl. ..... 339/59 M; 339/103 C; 339/103 M

[58] Field of Search ..... 339/59 R, 59 M, 62, 339/63 R, 63 M, 138, 139 R, 139 C, 91 R, 141, 103 R, 103 M, 103 O

[56] References Cited

U.S. PATENT DOCUMENTS 4,072,383 2/1978 Cameron et al. ..... 339/59 R
4,105,278 8/1978 Braund et al. ..... 339/103 M
4,448,769 12/1984 Feigl ..... 339/103 M
4,449,776 5/1984 Carmo et al. ..... 339/103 C

*Primary Examiner*—Gil Weidenfeld
*Assistant Examiner*—Paula A. Austin
*Attorney, Agent, or Firm*—C. D. Lacina

[57] ABSTRACT

A pair of connector members (10,30) have cylindrical portions (12,32) which mate along a first direction, one and the other member having an angled cable support (20,26) and a rectangular end portion (34) adapted for fitment in a configured opening (44) of a connector receptacle (40) in only of selected angular positions and only in a second direction whereby to orient the mated members and the cable support relative to the receptacle. An integrally formed latch arrangement (16,18) and terminal retention arrangement (60,58) allows for snap-in assembly.

6 Claims, 10 Drawing Figures

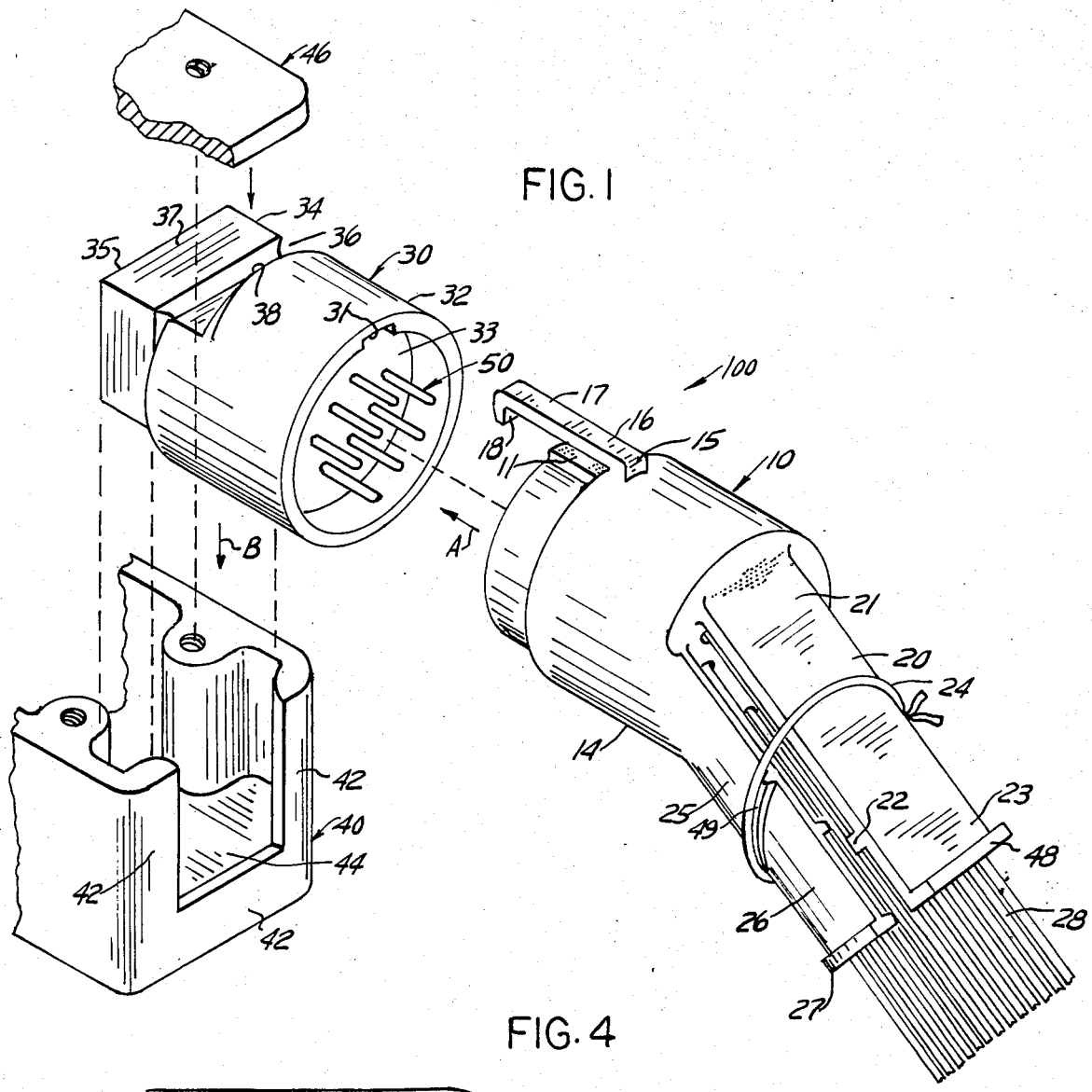
FIG. 1
FIG. 4
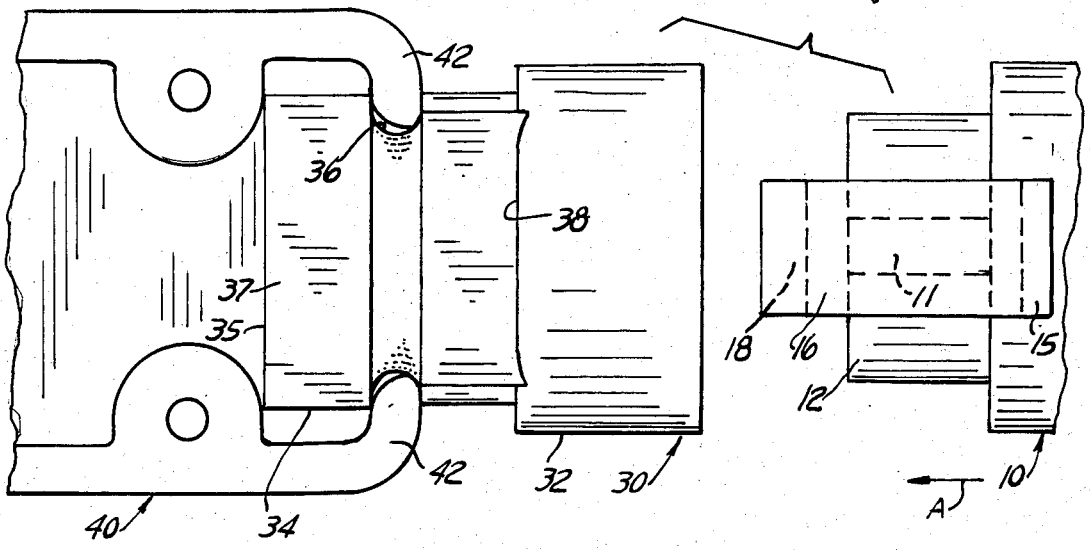

MULTI-PART ELECTRICAL CONNECTOR ASSEMBLY

The present invention relates to electrical connectors, and more particularly to a multiple electrical connector assembly which is especially adapted to reliably couple and lock connector parts together while permitting release without tools and, preferably, by one-hand operation so that inaccessibly located connections can be reliably joined, or disconnected, without requiring tools or excessive manipulation.

It is known to provide multi-terminal interconnecting arrangements wherein one of the connecting parts engages another connecting part by snap element which snaps over a projection or into a recess on the other part. Many such connectors are used in automotive field. One such example, shown by "Two-Part Separable Electrical Connection Arrangement", U.S. Pat. No. 4,435,033 issuing to Gansert et al. Mar. 6, 1984, requires the housing walls to function in a fulcrum arrangement. While advantageously making connector parts integral, using connector walls as fulcrums and requiring pivoting of connecting parts could develop wall stresses and lead to problems. Other connectors are not integrally formed and rivet projecting locking elements to the connector parts, the riveted locking element possibly being a spring metal component.

In "Electrical Connector With Improved Cable Support", U.S. Pat. No. 3,732,526 issuing May 8, 1973 to Punako and "Plastic Cable Support", U.S. Pat. No. 3,742,559 issuing July 3, 1973 to Punako et al., it is known to attach a separate wire restraint boot to a connector back shell, these boots including a pair of like semi-circular conduits each having their free ends deflected together to captivate the wires into a bundle and align the bundle in an axial direction relative to the primary axis of the connector shell. Connections in tight spaces may limit angular orientation of mated connector shells and parts thereof and may limit both angular and axial orientation of terminated wires. The semi-circular conduits are typically of equal cross-section (i.e. strength) such that if the orientation of the wires leaving the connector was other than axial, flexure stresses could be a problem.

Electrical terminals typically include a retention arrangement such as by means of a medical collar being captivated by fingers in a passage of a dielectric insert. In "Electrical Contact Retention Insert Method Molding Same", U.S. Pat. No. 4,421,378, issueing Dec. 20, 1983 to Sanford et al., a separate cylindrical retention clip is inserted into an enlarged cavity formed in the passage. A metal clip forced axially could cut into the insert and damage the insert. Further, since the clip has a fixed length, molding the passage would be more difficult and could possibly require more percise molding than needed in some low cost connector applications.

It would be desirable to provide a separable connector assembly, particularly adapted for tight spaces, wherein connector parts are integrally formed to the fullest degree possible and in which the parts can be readily connected in a snap-in type action or disconnected and require only one-hand operation of the connector parts when the parts are to be manipulated.

In accord with this invention, a first and second connector part have a cylindrical forward end portion each configured for mating along a first connector axis whereby a latch member on one connector part engages within a recess formed by a transverse lip on the other connector part whereby to lockingly hold the two connector parts together, the second connector part, either alone or in the locked assembly, being adapted to interfit within a specially configured connector receptacle by movement thereof in a second axial direction. The first connector part includes support means for supporting a plurality of wires exiting rearwardly from their termination to respective electrical terminals disposed therein, the support means including a rigid support member and a pliant cover member integrally formed to the connector shell with the rigid support member extending therefrom at an acute angle to the assembly axis and supporting the wires and the pliant cover member deflecting downwardly towards the support member and about the wires whereby to be tied into a captivated wire bundle which will extend in a direction angling acutely downwardly from the connector. The second connector part includes a rectangular portion configured for only selected angular connections with the receptacle. Each terminal is mounted in its respective passage as a result of elastically deforming a constriction in the passage formed by an inward flat on each of a pair of cams.

An advantage of the above arrangement is that the connector parts lock together without the need of special parts or tools and also as an unlocking or release period. The connector assembly angularly orients the connector parts and orients the wire bundle so as to extend downwardly as the result of a rigid and a flexible conduit cooperating to support and captivate the wires so bundled. The electrical terminals are easily captivated by an integral retention arrangement.

In accordance with a preferred feature of the invention, the above and other features will be understood in accordance with the drawings and specification attached hereto. In particular:

FIG. 1 is an exploded assembly view of a multi-part electrical connector assembly positioned for mating.

FIG. 4 is a top view detailing portions of the connector assembly of FIG. 1.

Figure 2:
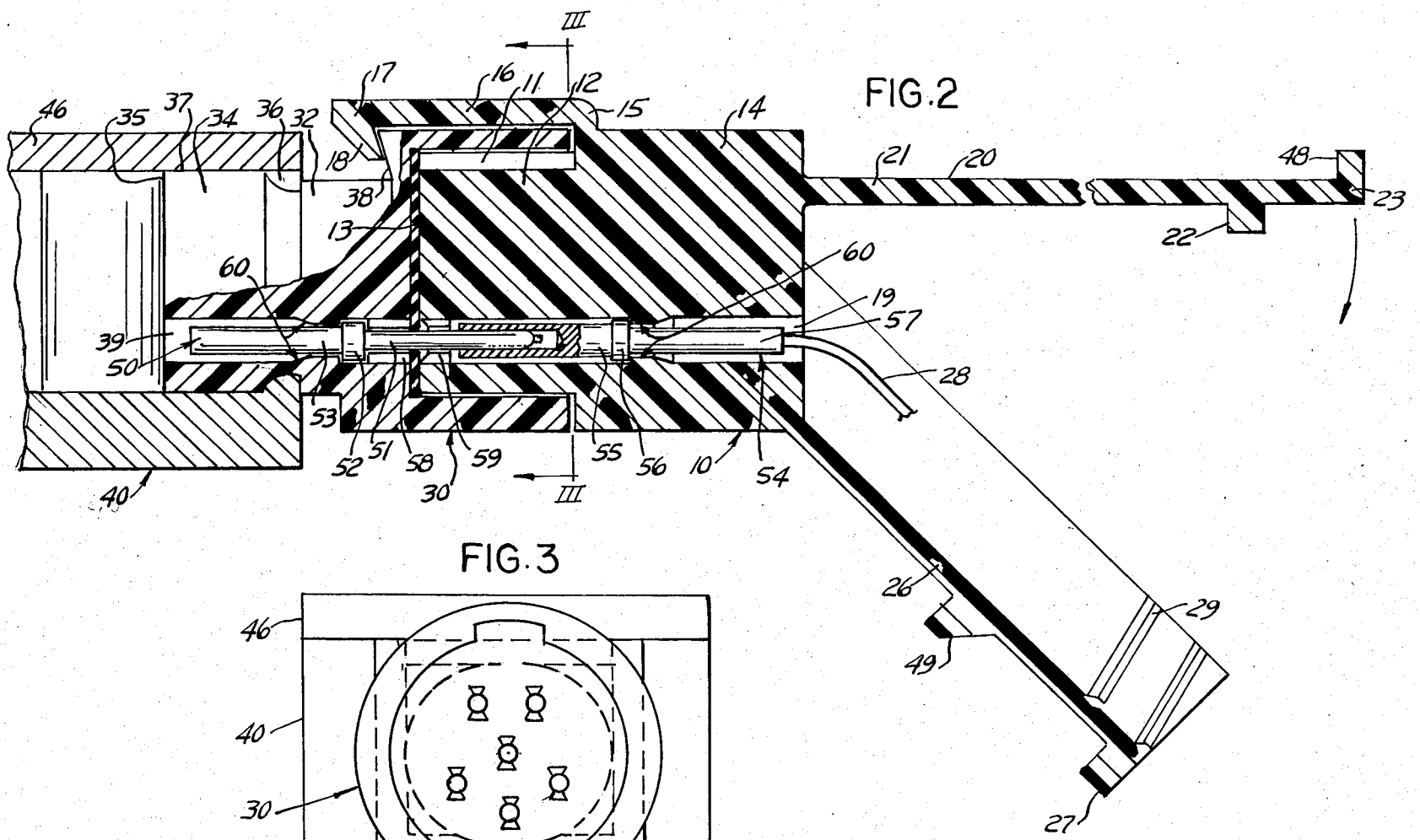
FIG. 2 is a partial section view of the connector assembly when mated.

Referring now to the drawings, FIG. 1 shows a multi-part connector assembly 100 as comprising a first and a second connector member 10,30 with each connector member having, respectively, a foreward end portion 12,32 configured for mating with one another along a first axial direction "A" and a rearward end portion 14,34, the rearward end portion 14 of the first connector member 10 receiving a plurality of insulated electrical cables 28 each terminated to a respective electrical terminal 54 (see FIG. 2) disposed therein and the rearward end portion 34 of the second connector member 30 being configured for interlocking mating within a rectangular opening 44 of a connector receptable 40 only at selected angular positions of the second connector member relative to the opening and only along a second axial direction "B" defined by a plane substantially perpendicular to the first axial direction.

Each connector member 10,30 is integrally formed of an electrically insulative material and each includes an array of passages 19,39 (see FIGS. 2) extending therethrough, each passage receiving an electrical terminal 54,50 with respective terminals in one and the other connector member being adapted to mate with one another.

The forward end portion 12,32 of each connector member is substantially cylindrical in cross-section. The rearward end portion 34 of the second connector member 30 is generally rectangular in cross-section and includes a groove 36 extending therearound which is adapted to interlock within flanges 42 forming the rectangular opening 44 of the connector receptacle. Such a design allows the rearward end portion 34 of the second connector member 30 to orient the connector members 10,30 when mated relative to the receptacle, the orientation allowing four 90° orientation positions. Although a rectangular cross-section is shown for the rearward end portion 34, a suitably dimensioned geometrical shape with a like extending groove sized to be captivated by the flanges and opening width would equally work and allow for more assembly orientations.

Orienting means for orienting the forward end portions 12,32 includes a key 11 on the first connector member 10 being sized to be received within a keyway 31 on the second connector member 30.

Latching means for releasably latching the mated forward end portions 12,32 together includes an elongated longitudinally extending latch member 16 and a transverse lip 38, the latch member 16 having one end 15 integral with the first connector member 10 and a deflectable free end 17 formed by a transverse hook 18 turned downwardly towards the connector member and adapted to seat against the transverse lip on the second connector member 30.

The first connector member 10 includes support means for supporting the cables, the support means including a cable tie 24, a relatively rigid, inflexible, support beam 26, and a relatively flexible cover beam 20, each of the beams having a respective first end 25,21 being integrally formed with the first connector member and extending therefrom to a respective second end 27,23. The support beam 26 is generally semi-circular in cross-section and extends downwardly from the connector members at an acute angle to the first axial direction "A". The cover beam 20 is generally rectangular in cross-section and extends axially from the connector member. The cover beam is adapted to deflect downwardly about the second end 27 of the support beam 26 to form a closure about the cables about which the cable tie 24 is tied whereby to captivate the cables into a bundle. The beams 26,20 each include, respectively, an exterior top face including a rib 48,49 for axially positioning the cable tie and an interior bottom face including a rib 29,22 for gripping the cables so bundled.

A removable cover 46 is advanced downwardly in the direction "B" upon the rearward end portion 34 of the second connector member 30 for bearing against the flat face 37 and captivating the second connector member in the connector receptacle. The rearward end portion 34, being rectangular, has four such flat faces 37, each being the bearing face depending on the angular orientation of the end portion.

FIG. 2 shows a complete electrical connector assembly. As shown, the first connector member 10 receives a plurality of socket-type electrical terminals 54 (only one shown) which mate with a respective plurality of pin-type electrical terminals 50 (only one shown) in the second connector member 30. Each terminal 50,54 includes, respectively, a front end portion 51,55 for mating with one another, a rearward end portion 53,57, and a medical retention collar 52,56 with the rearward end portions 57 in the first connector member 10 being terminated to a respective cable 28 and the rearward end portions 53 in the second connector member 30 being adapted for electrical interconnection inside the connector receptacle 40.

Each passage 19,39 includes respectively, a support portion 59,58 at a forward end portion of its passage for supporting and centering the front end portion of the pin or socket terminal along its passage axis, and a pair of cams 60 forming a constriction in the passage. The cam 60 is the same for each connector member and includes an inclined surface 61 extending from the passage wall radially inward, a transverse end face 63 forming a shoulder spaced axially rearward from a transverse end wall 64 of the terminal supports whereby to define a retention cavity 66 for captivating the retention collar, and a flat 62 disposed in a plane generally parallel to the passage axis. The pair of cams in each passage have their flat faces 62 parallel one to the other and the cams are approximately 90° from the terminal supports 58.

A elastomeric seal 13 may be disposed between the mating faces of the two connector members 10,30 whereby to provide a slight axial bias to force the hook of the latch member 16 to be biased rearwardly once seated behind the lip 38.

Figure 3:
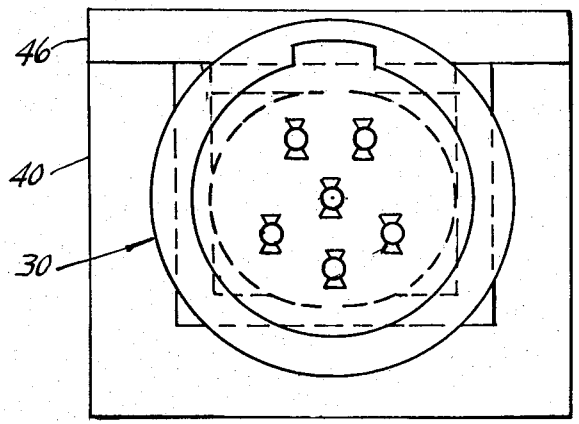
FIG. 3 is a view taken along lines III—III of FIG. 2 showing an end view of one connector part.

FIG. 3 shows a view taken along lines III—III of FIG. 2, without the first connector member 10, showing the second connector member 30 captivated in one of four angular 90° positions in the receptacle 40.

FIG. 4 shows a top view of the first connector member 10 about to mate with the second connector member 30, the second connector member being disposed within the connector receptacle 40. Each of the flanges 42 have sloped faces and are received within the groove 36 which extends around the rearward end portion 34, the sloped faces reducing the stresses on the connector housing as a result of flexure or withdrawal forces which may be placed on the cable bundle and connector assembly so formed.

Figure 5:
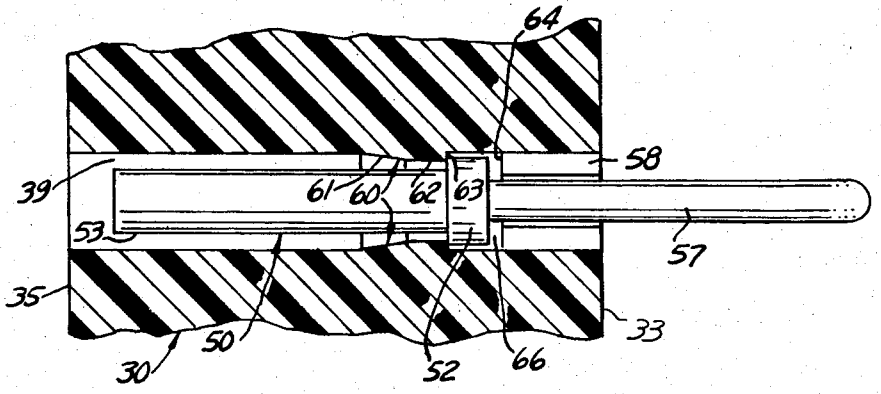
FIG. 5 is a partial side view in section of an electrical terminal mounted in one connector part.

FIG. 5 shows the pin-type electrical terminal 50 disposed within the passage 19 of second connector member 30, the passage being generally cylindrical in cross-section as are the terminals. While the description to follow is directed to the second connector member 30, the same would hold for the passage 19 and terminal 54 in the first connector member 10. Second connector member 30 comprises an integral dielectric body having a front face 33, a rear face 35, and the passage extending axially between the faces.

The retention means for retaining the terminal in the passage includes the terminal supports 58 being disposed adjacent to the front face and extending axially rearward from the front face and terminating in the end wall 64 passage and centering the front end portion 51 of the terminal 50 along the passage axis, and the pair of cams 60 extending radially inward into the passage whereby to form the constriction in the passage. Each of the cams are spaced medially of the faces 33,35 and include the inclined surface 61 extending radially inward and axially forward, the flat surface 62 disposed in a plane parallel to the passage axis, and the end face 63 disposed in a plane perpendicular to the passage axis, an axial separation between end face 63 and end wall 64 forming the retention cavity 66 for captivating the retention collar 52.

Figure 6:
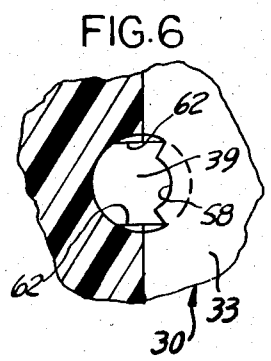
FIGS. 6–7 are end views of the connector part shown in FIG. 5 without the terminal.

FIG. 6 is a view of the front face 33 showing to the right the terminal supports 58 and the flat face 62 of the cams 60 and to the left, the connector rearwardly of the terminal supports and showing the flat faces 62 and partially in section.

Figure 7:
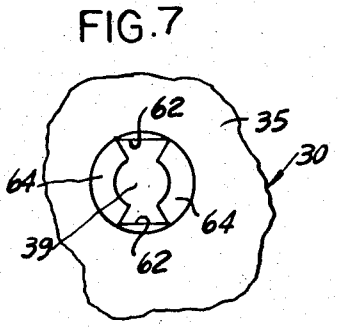

FIG. 7 is a view of the rear face 35, the terminal supports and their end walls 64.

Figure 8:
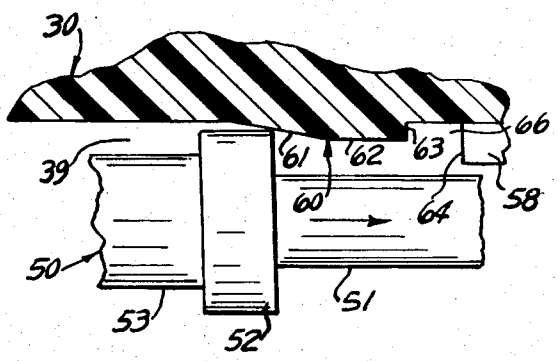
FIGS. 8–10 show rearward insertion of the terminal into a passage.
Figure 9:
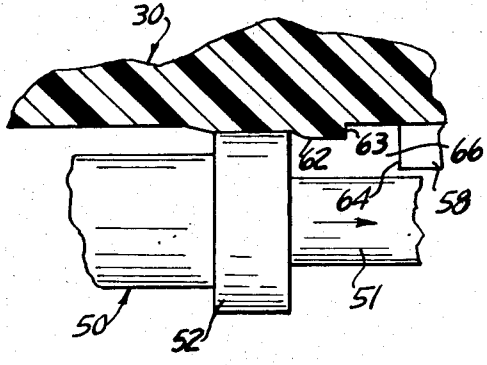
Figure 10:
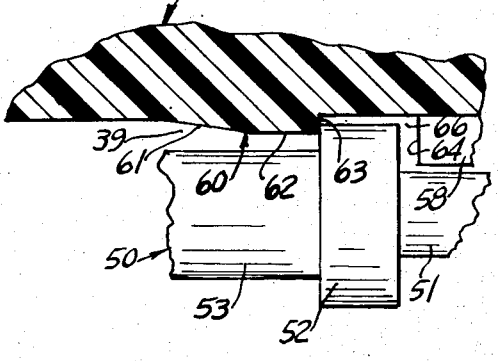

FIGS. 8-10 show the electrical terminal 50 being inserted into the passage 39. In FIG. 8 the annular collar 52 is abutting against the inclined surface 61. FIG. 9 shows further inward insertion whereby the retention collar compressively deforms the inclined surface 61 and the flat face 62 thereof radially outward. Further insertion causes the annular collar to advance forwardly therefrom and seat forwardly of the end face 63 and rearwardly of end wall 64 of the terminal supports 58 to be captivated in the retention cavity 66 formed within the passage.

What is claimed is:

1. A connector assembly comprising a first and a second connector member each having a forward end portion configured for mating with one another along a first axial direction and a rearward end portion, orienting means for orienting said forward end portions, and latching means for releasably latching the mated forward end portions together, the rearward end portion of said first connector member receiving a plurality of insulated electrical cables each terminated to a respective electrical terminal disposed therein and including support means for supporting the cables, characterized by the rearward end portion of the second connector member being configured for interlocking mating within an opening of a connector receptacle only at selected angular positions of the second connector member relative to the opening and along a second axial direction defined by a plane substantially perpendicular to the first axial direction, said support means including a cable tie, a relatively rigid, inflexible semi-cylindrical support beam and a relatively flexible planar cover beam, and means for positioning the cable tie about the beams, each beam having, respectively, a first end integrally secured to said first connector member, a second end, and a rib for gripping the cables, the support beam extending at an acute angle to the first axial direction and the second end of the cover beam being adapted to deflect downwardly about the second end of the support beam to form a closure about the cables about which the cable tie is tied whereby to captivate the cables.

2. The assembly as recited in claim 1 wherein the forward end portion of each said connector member is substantially cylindrical in cross-section, the rearward end portion of said second connector member is rectangular in cross-section and includes a groove therearound adapted to interlock within flanges forming the opening of the connector receptacle.

3. The assembly as recited in claim 2 wherein the latching means comprises one said connector member including an elongated, longitudinally extending, latch member and the other connector member including a transverse lip, the latch member having one end integral with the one connector member and a deflectable free end formed by a transverse hook turned downwardly towards the one connector member and adapted to seat against the transverse lip on the other connector member.

4. The assembly as recited in claim 1 wherein each said connector member is integrally formed of an electrically insulative material and each includes an array of passages extending therethrough each passage receiving an electrical terminal with respective terminals in one and the other connector member being adapted to mate, each said terminal including a front end portion for mating, a rearward end portion and a medial retention collar with the rearward end portions in said one connector member being terminated to a respective cable and the rearward end portions in said other connector member being adapted for electrical connection inside said connector receptacle, and each said passage including centering means at a forward end portion of the passage for centering the front end portion of the terminal along the passage axis and a cam forming a constriction in the passage, the cam including an inclined surface extending from the passage wall radially inward, a transverse end face forming a shoulder spaced axially rearward from said support means whereby to define a retention cavity for captivating said retention collar, and a flat disposed in a plane generally parallel to the passage axis, said retention collar having to elastically deform said flat in order for said terminal to be received in said retention cavity.

5. The assembly as recited in claim 4 wherein each passage includes a pair of cams with the flats being parallel to one another.

6. A connector assembly comprising a first and a second connector member each having a forward end portion configured for mating with one another along a first axial direction and a rearward end portion, orienting means for orienting said forward end portions, and latching means for releasably latching the mated forward end portions together, the rearward end portion of said first connector member receiving a plurality of insulated electrical cables each terminated to a respective electrical terminal disposed therein and including support means for supporting the cables, characterized by a receptable connector comprising a plurality of flanges each being disposed in a plane perpendicular to the first axial direction and cooperating a form a rectangular opening, two of said flanges being laterally separated and extending along the second axial direction and a third flanges extending between the two said flanges in a third direction, and means for removably captivating the second connector member in the receptacle connector.

the rearward end portion of the second connector member being configured for interlocking within the opening and having a groove which receives the respective flanges and only at selected angular positions of the second connector member relative to the opening and along a second axial direction defined by a plane substantially perpendicular to the first axial direction, and said support means including a rigid, relatively inflexible, support beam, a deflectable cover beam, each beam having a respective first end integrally secured to said first connector member and extending therefrom to its respective second end, the support beam extending at an acute angle to the first axial direction and the second end of the cover beam being adapted to deflect downwardly about the second end of the support beam to form a closure about the cables, and means for securing the beams about the cables when the beams are brought together whereby to captivate the cables in the closure.

* * * * *